United States Patent [19]

Struble

[11] 3,933,288

[45] Jan. 20, 1976

[54] DISPENSING CARTON WITH CUTTING EDGE

[75] Inventor: Glenn E. Struble, Oxford, Ohio

[73] Assignee: Diamond International Corporation, New York, N.Y.

[22] Filed: Nov. 15, 1974

[21] Appl. No.: 524,330

[52] U.S. Cl. ..... 225/49; 225/48; 229/51 TS

[51] Int. Cl.[2] ..... B26F 3/02

[58] Field of Search ..... 225/39, 48, 49, 50; 229/17 S, 37 R, 51 TS

[56] References Cited

UNITED STATES PATENTS

| | | | |
|---|---|---|---|
| 3,096,918 | 7/1963 | Van Dyke et al. | 229/51 TS X |
| 3,137,424 | 6/1964 | Finn et al. | 225/48 |
| 3,193,427 | 7/1965 | Rogers | 225/49 |
| 3,477,624 | 11/1969 | Branyon et al. | 225/48 X |
| 3,642,185 | 2/1972 | Woodling | 225/48 |

*Primary Examiner*—J. M. Meister
*Assistant Examiner*—Fred A. Silverberg
*Attorney, Agent, or Firm*—Karl W. Flocks

[57] ABSTRACT

A carton for dispensing sheet material having a cutting edge formed on the edge of the carton blank and folded in the closed carton with the cutting edge protected by the tear strip, until said tear strip is removed, though protruding over a carton edge in the path of the sheet material.

The cutting edge is formed by treating with an indurating agent or application of a polystyrene strip.

6 Claims, 8 Drawing Figures

DISPENSING CARTON WITH CUTTING EDGE

BACKGROUND OF THE INVENTION

The present invention refers to a carton for dispensing sheet material and in particular to a carton having a cutting edge to cut off desired lengths of said sheet material.

The prior art discloses cartons for dispensing sheet material having cutting edges. In some cases the cutting edges have been formed by attaching a serrated metal strip to the carton either at an edge or intermediate point in the path of the sheet material emanating from the carton.

Also in the prior art a cutting edge has been formed on the carton blank itself by the application of an indurating material to an edge either before or after cutting the edge in a serrated pattern.

SUMMARY OF THE INVENTION

It is an object of the present invention to provide a cutting edge on a carton for dispensing sheet material with the cutting edge made from edge hardened paperboard material or polystyrene strip applied thereto positioned in such a manner as to project outward from an outside panel for ease of tearing contents of the carton such as plastic wraps, wax paper, foil, etc.

It is a further object of the present invention to form the carton so that the outward projecting edge can be protected by a cover during transit before opening the carton for first use. Similarly the consumer is protected from the edge at that time.

It is also an object of the present invention to accomplish the above at a saving in cost by elimination of the metal edging operation and by use of a straight line gluing operation.

The present invention comprises a carton blank having a cutting edge formed of a hardened paperboard material, or by application of a polystyrene strip and serrating of the edge with strip attached, with sides so proportioned as to allow folding of the cutting edge beneath the tear strip during assembly so as to require tearing of the tear strip for exposure of the cutting edge.

BRIEF DESCRIPTION OF THE DRAWINGS

The invention is described in detail in connection with the accompanying drawings in which.

DESCRIPTION OF THE PREFERRED EMBODIMENT

Figure 1:
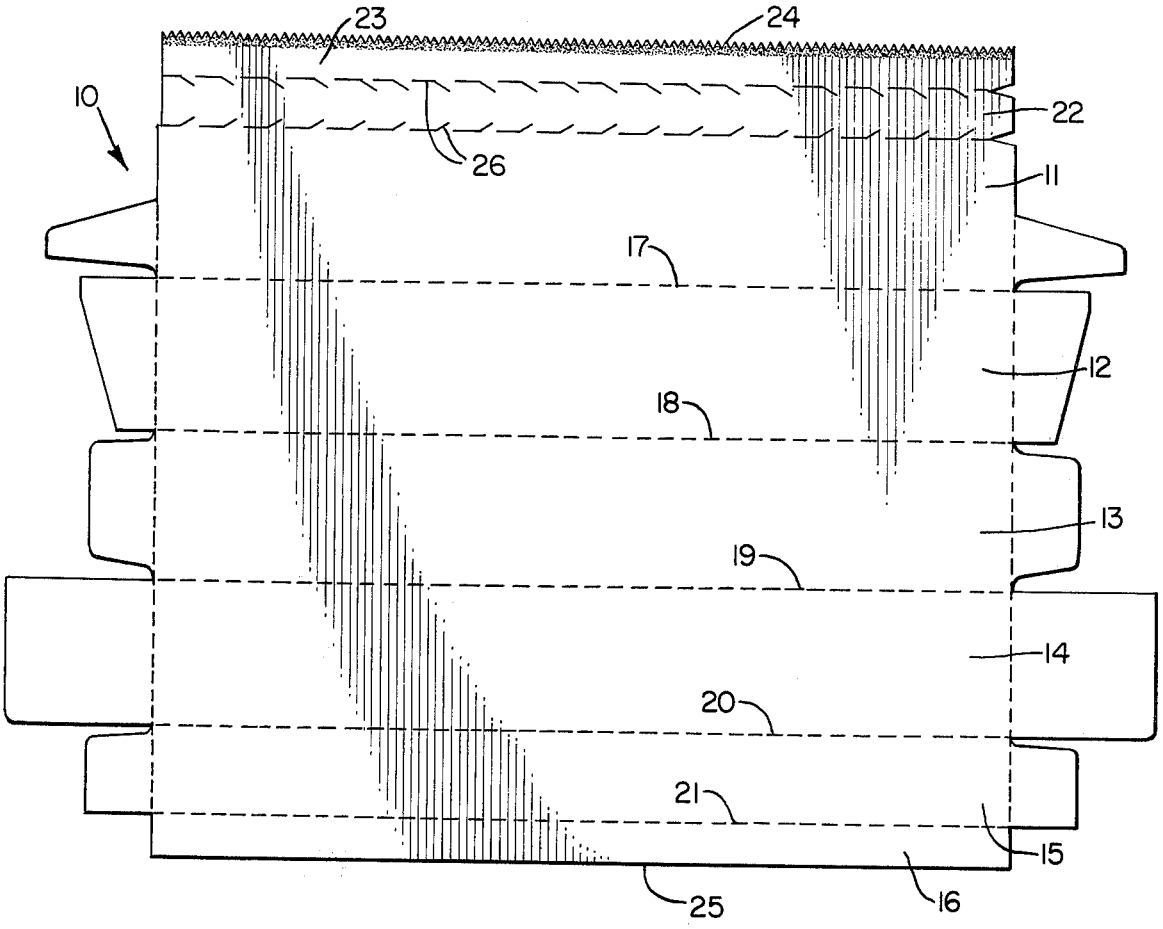
FIG. 1 is an open blank viewed from the side of the outside surfaces.

Referring first to FIG. 1, there is shown a carton blank 10 of paperboard material having a front wall panel 11, a top wall panel 12, a rear wall panel 13, a base panel 14, an overlap panel 15, and a free edge portion 16 connected by crease lines 17, 18, 19, 20, and 21, respectively. Each of panels 11 through 15 have end flaps which interfit when the carton is assembled. This view of the blank shows the surfaces which form the outside of the assembled carton.

Attached to the opposite side of front wall panel 11 from crease line 17 is tear strip 22 and cutter strip 23 with cutting edge 24 on its outer edge.

The shorter dimensions of panels 11 through 14 are substantially equal except that base panel 14 may have that dimension slightly less than the corresponding dimension on front wall panel 11, but the dimension of overlap panel 15, between crease lines 20 and 21, is less than any of the individual shorter dimensions of panels 11 through 14. Also the width of cutter strip 23, including the teeth of cutter edge 24 should be slightly less than the width, between tear strip perforations 26, of tear strip 22.

Figure 2:
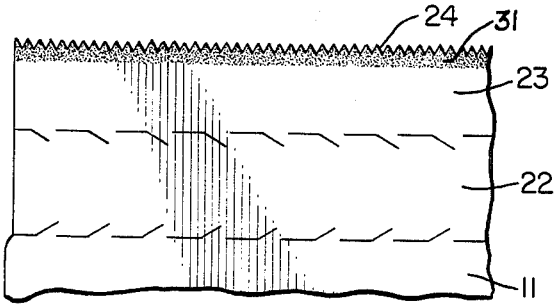
FIG. 2 is an enlarged view of the upper left corner of FIG. 1 showing the cutting edge with an indurating agent along the serrated edge.
Figure 3:
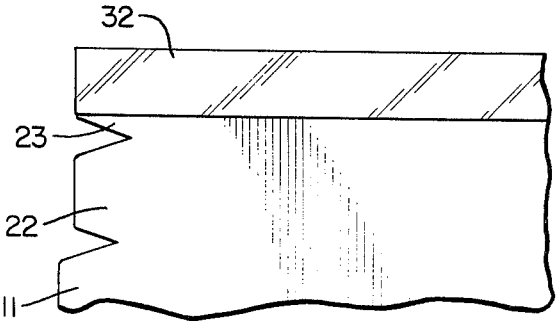
FIG. 3 is an enlarged view showing the inside surface of the blank of FIG. 1 (upper right corner) with a polystyrene strip before cutting the serrated edge.
Figure 4:
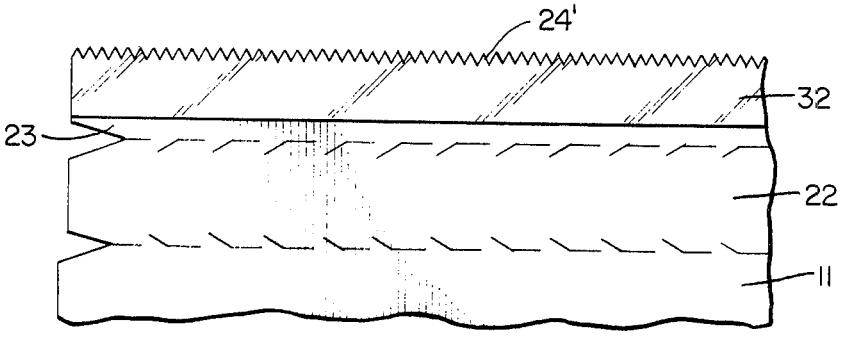
FIG. 4 is a view of the same portion as FIG. 3 after cutting the serrated edge.

FIGS. 2, 3, and 4 show two ways of forming cutter edge 24 and 24'. FIG. 2 shows the cutting edge 24, as in FIG. 1 formed with an indurating or hardening agent 31 on cutter strip 23 along cutting edge 24. The indurating agent 31 is spread on both surfaces of cutter strip 23.

In FIG. 3 a corner of carton blank 10 is shown but instead of an indurating agent, a polystyrene strip 32 is glued on to cutter strip 23, either on the inside surface as shown in FIG. 3 or on the outside surface. The punching or cutting operation forming cutting edge 24' may be accomplished at the same time as the forming of tear strip perforations 26 and during the punching out of carton blanks 10.

Figure 5:
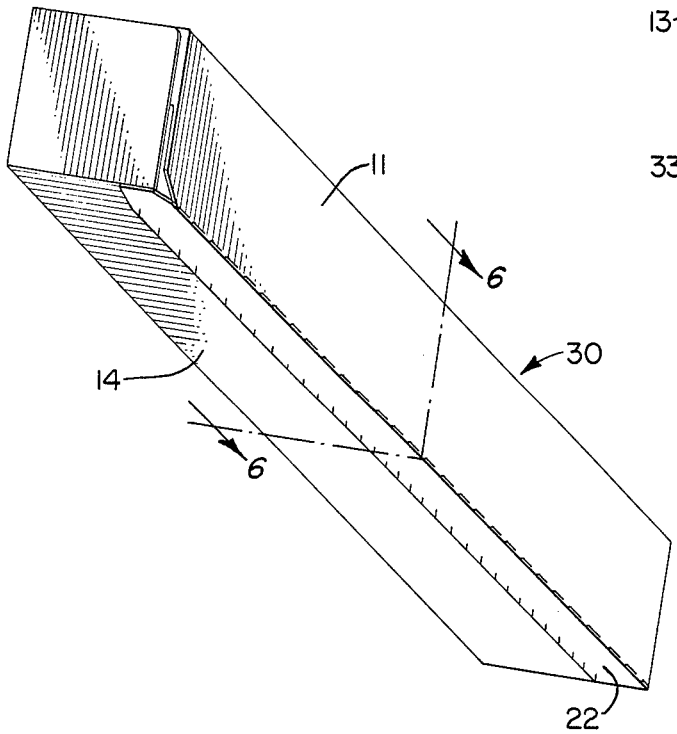
FIG. 5 is a perspective view of the carton assembled in fully closed condition.

By bending the paperboard material of carton blank 10 along crease lines 17–21, perforations 26 and the crease lines connecting the end flaps to the panels, and gluing the end flaps in the usual manner, the carton 30 shown in FIG. 5 is formed.

Figure 6:
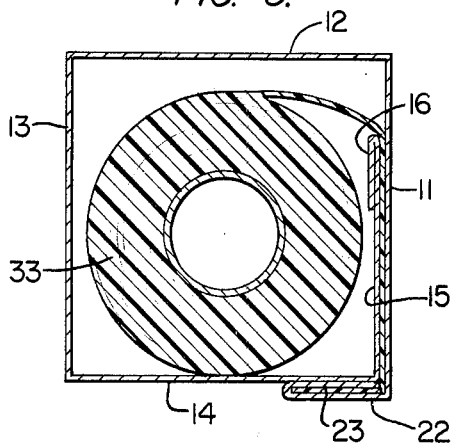
FIG. 6 is a cross-sectional view along lines 6—6 of FIG. 5.

In forming carton 30, cutter strip 23, which has been folded back over tear strip 22 is glued along the edge of base panel 14 as shown in FIG. 6. In FIG. 6 the cutter edge is formed utilizing the polystyrene strip 32 as discussed in connection with FIGS. 3 and 4 forming cutting edge 24' which in this assembled position extends slightly beyond the edge of the base panel 14 at crease line 20. In the assembled form as shown in cross-section in FIG. 6, front wall panel 11 extends below overlap panel 15 covering the teeth of cutting edge 24' with its attachment to tear strip 22.

A roll of sheet material 33 is inserted in carton 30 at some point during assembly, probably before closing of the end flaps. This roll of sheet material 33 is placed so as to unwind in a direction over crease line 21 where free edge portion 16 has been folded over and glued to the inner side of overlap panel 15 so as to act as a stiffener for panel 15. Material 33 then passes between overlap panel 15 and front wall panel 11 so as to pass over cutter edge 24' or 24 after its exposure by the removal of tear strip 22.

Figure 7:
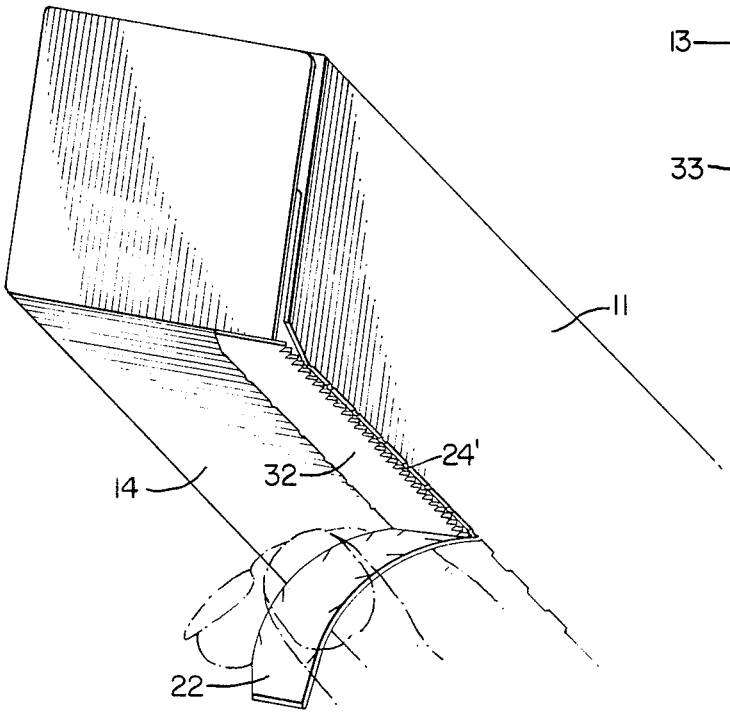
FIG. 7 is an enlarged perspective view of the carton of FIG. 5 with the tear strip being removed.
Figure 8:
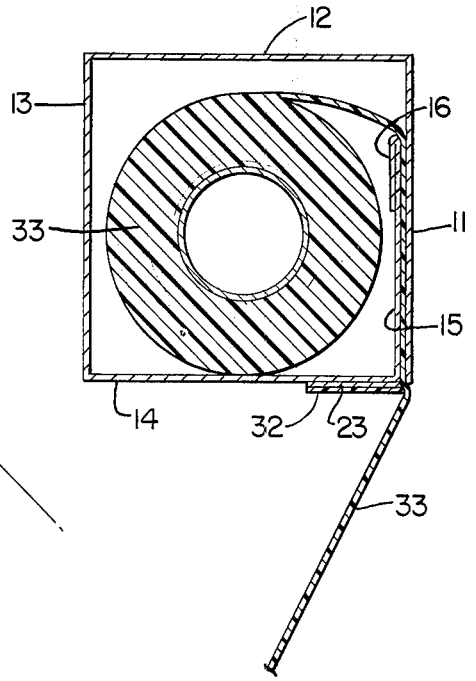
FIG. 8 is a cross-sectional view as in FIG. 6 but as in use prior to tearing sheet material from in the carton.

Tear strip 22 is removed by tearing along perforations 26 as shown in FIG. 7. Sheet material 33 is then pulled down between front wall panel 11 and overlap panel 15 in front of the serrated cutting edge 24' against which material 33 can be torn to the size desired. FIG. 8 is a cross-section view with the tear strip 22 removed preparatory to tearing sheet material 33.

Either of serrated cutting edges 24' or 24 may be used with this carton. The carton has been shown in all views with the cutting edge extending from the base panel. This has been found the preferred way of using the construction of the present invention but this should not preclude the use of this same construction in a manner rotated from that shown, still within the concept of the present invention which allows a covering of the serrated cutting edge until it is exposed for use, while providing for its projection beyond an edge of the carton in the path of the sheet material.

It will be obvious to those skilled in the art that various changes may be made without departing from the scope of the invention and the invention is not to be considered limited to what is shown in the drawings and described in the specification.

What is claimed is:

1. A carton for dispensing sheet material formed from a blank of paperboard material or the like comprising a front wall panel, a top wall panel, a rear wall panel, a base panel, and an overlap panel connected in the aforementioned consecutive order, a tear strip connected to said front wall panel along the opposite side from the connection of said front wall panel to said top wall panel, a cutter strip connected to said tear strip on the opposite side of said tear strip from the connection of said tear strip to said front wall panel, a cutting edge on said cutter strip on the free end of said cutter strip opposite to its connection to said tear strip, said cutter strip folded back under said tear strip and attached to said base panel.

2. The carton for dispensing sheet material formed from a blank as in claim 1 further characterized by said overlap panel having a transverse dimension less than a transverse dimension in the same direction of said front wall panel.

3. The carton as in claim 1 further characterized by said cutter strip having an indurating material thereon along said cutting edge.

4. The carton as in claim 1 further characterized by a strip of polystyrene material attached to said cutter strip having a serrated edge to form said cutting edge.

5. The carton as in claim 1 further characterized by said cutter strip attached to said base panel with said cutting edge extending past the edge of said base panel.

6. The carton as in claim 1, further characterized by a free edge portion connected to said overlap panel at the opposite side from its connection to said base panel and said cutter strip.

* * * * *